US008887356B2

(12) United States Patent
Bailey

(10) Patent No.: US 8,887,356 B2
(45) Date of Patent: Nov. 18, 2014

(54) HINGED DOWNSPOUT

(76) Inventor: Lance D. Bailey, Omaha, NE (US)

( * ) Notice: Subject to any disclaimer, the term of this patent is extended or adjusted under 35 U.S.C. 154(b) by 0 days.

(21) Appl. No.: 13/367,343

(22) Filed: Feb. 6, 2012

(65) Prior Publication Data

US 2013/0000080 A1 Jan. 3, 2013

Related U.S. Application Data

(60) Provisional application No. 61/502,801, filed on Jun. 29, 2011.

(51) Int. Cl.

| | |
|---|---|
| ***E05D 5/06*** | (2006.01) |
| ***E05D 5/12*** | (2006.01) |
| ***E05D 5/04*** | (2006.01) |
| *E05D 5/10* | (2006.01) |

(52) U.S. Cl.

CPC ..... *E05D 5/127* (2013.01); *E05Y 2800/29* (2013.01); *E05Y 2900/00* (2013.01); *E05Y 2800/45* (2013.01); *E05Y 2800/00* (2013.01); *E05Y 2800/21* (2013.01); *E05D 5/06* (2013.01); *E05D 2005/102* (2013.01); *E05D 5/04* (2013.01); *E05Y 2900/60* (2013.01)

USPC ..... 16/390; 16/382; 16/386; 16/387

(58) Field of Classification Search

USPC ..... 16/390, 391, 392, 389, 252, 382, 384, 16/386, 387, 86.1; 403/153, 277, 278, 403/279; D8/323, 328, 329; 29/11; 49/381, 49/382; 256/21, 26, 54

See application file for complete search history.

(56) References Cited

U.S. PATENT DOCUMENTS

| | | | | | |
|---|---|---|---|---|---|
| 952,059 | A | | 3/1910 | Williiam | |
| 974,550 | A | | 11/1910 | Cardarelli | |
| 1,640,525 | A | * | 8/1927 | Belliveau | 16/390 |
| 2,268,669 | A | * | 1/1942 | Moore | 160/229.1 |
| 2,369,480 | A | * | 2/1945 | Mills | 24/561 |
| 2,975,805 | A | | 3/1961 | Horn | |
| 3,006,039 | A | * | 10/1961 | Brydolf | 49/398 |
| 3,060,952 | A | | 10/1962 | Bystrom | |
| 3,108,295 | A | * | 10/1963 | Schor et al. | 114/354 |
| 3,153,807 | A | * | 10/1964 | Nyman | 16/390 |
| 3,171,157 | A | * | 3/1965 | Loughlin | 16/390 |
| 3,316,928 | A | | 5/1967 | Weakley | |
| 3,375,851 | A | | 4/1968 | Fitz et al. | |
| 3,861,419 | A | | 1/1975 | Johnson | |
| 3,911,954 | A | | 10/1975 | Johnson | |
| 4,135,540 | A | | 1/1979 | Felsen | |
| 4,270,572 | A | | 6/1981 | Jarzynka | |
| 4,441,835 | A | * | 4/1984 | Davis | 403/24 |
| 4,485,544 | A | * | 12/1984 | Van Ryswyk | 29/417 |

(Continued)

FOREIGN PATENT DOCUMENTS

| | | | | |
|---|---|---|---|---|
| CA | 1188476 | A | * | 6/1985 |
| CA | 2163469 | A | * | 5/1997 |
| WO | 2005-019659 | | | 3/2005 |

*Primary Examiner* — Chuck Mah

(74) *Attorney, Agent, or Firm* — Dax D. Anderson; Kirton McConkie

(57) ABSTRACT

A hinge is disclosed that can allow a downspout extension to rotate from a horizontal position to a vertical position to allow people to easily access these areas about the downspout extension. In some instances, the hinge includes a first plate positioned on the inner wall surface of a downspout and a second plate positioned on an opposing outer wall surface of the downspout. The first and the second plates can be substantially parallel.

13 Claims, 11 Drawing Sheets

(56) References Cited

U.S. PATENT DOCUMENTS

| | | | | |
|---|---|---|---|---|
| 4,561,616 | A | 12/1985 | Robinson | |
| 5,014,745 | A | 5/1991 | Watt | |
| 5,199,218 | A * | 4/1993 | McQuade | 49/381 |
| 5,358,006 | A | 10/1994 | Sweers | |
| 5,358,007 | A | 10/1994 | Carlberg | |
| 5,375,891 | A | 12/1994 | Sicotte et al. | |
| 5,426,822 | A | 6/1995 | Weir | |
| 5,435,051 | A | 7/1995 | Cheremshynski | |
| 5,452,743 | A | 9/1995 | Rortvedt | |
| 5,511,829 | A | 4/1996 | Sicotte et al. | |
| D372,852 | S * | 8/1996 | Noll et al. | D8/328 |
| 5,673,519 | A | 10/1997 | McCaughan | |
| 5,735,085 | A | 4/1998 | Denooy | |
| 6,701,675 | B1 | 3/2004 | Ekker et al. | |
| 6,880,295 | B2 | 4/2005 | Frey | |
| D557,586 | S | 12/2007 | Shire et al. | |
| 7,665,187 | B1 * | 2/2010 | Elowsky | 16/390 |
| 7,958,680 | B2 * | 6/2011 | DeNooy | 52/97 |
| 2008/0251150 | A1 | 10/2008 | Denooy et al. | |
| 2010/0089407 | A1 | 4/2010 | Gardner et al. | |

* cited by examiner

HINGED DOWNSPOUT

RELATED APPLICATIONS

This application claims priority to provisional patent application No. 61/502,801, filed Jun. 29, 2011.

BACKGROUND

Background of the Invention and Related Art

The present invention relates to downspouts and hinged downspout extensions. Downspouts are often used to control water flow coming off of roofs. Downspouts distribute water onto the ground and potentially away from the foundation of a building by use of extensions that take the water from the downspout to a distance away from a foundation of a building. However, oftentimes, these downspout extensions interfere with foot traffic, lawn maintenance, and yard care around the foundation of the building.

SUMMARY AND OBJECTS OF THE INVENTION

A hinge is disclosed that can allow a downspout extension to be connected to a downspout that allows the downspout to be easily rotated from a relatively horizontal position to a relatively vertical position in which people can access the areas where the downspout extension. Various hinge embodiments are described herein. For example, in some embodiments, the hinge includes a first plate positioned on the inner wall surface of a downspout and a second plate positioned on an opposing outer wall surface of the downspout. The wall is secured to the hinge and reinforced as a fastener is extended though the first plate, the downspout wall, and the second plate.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE EXEMPLARY EMBODIMENTS

Figure 1:
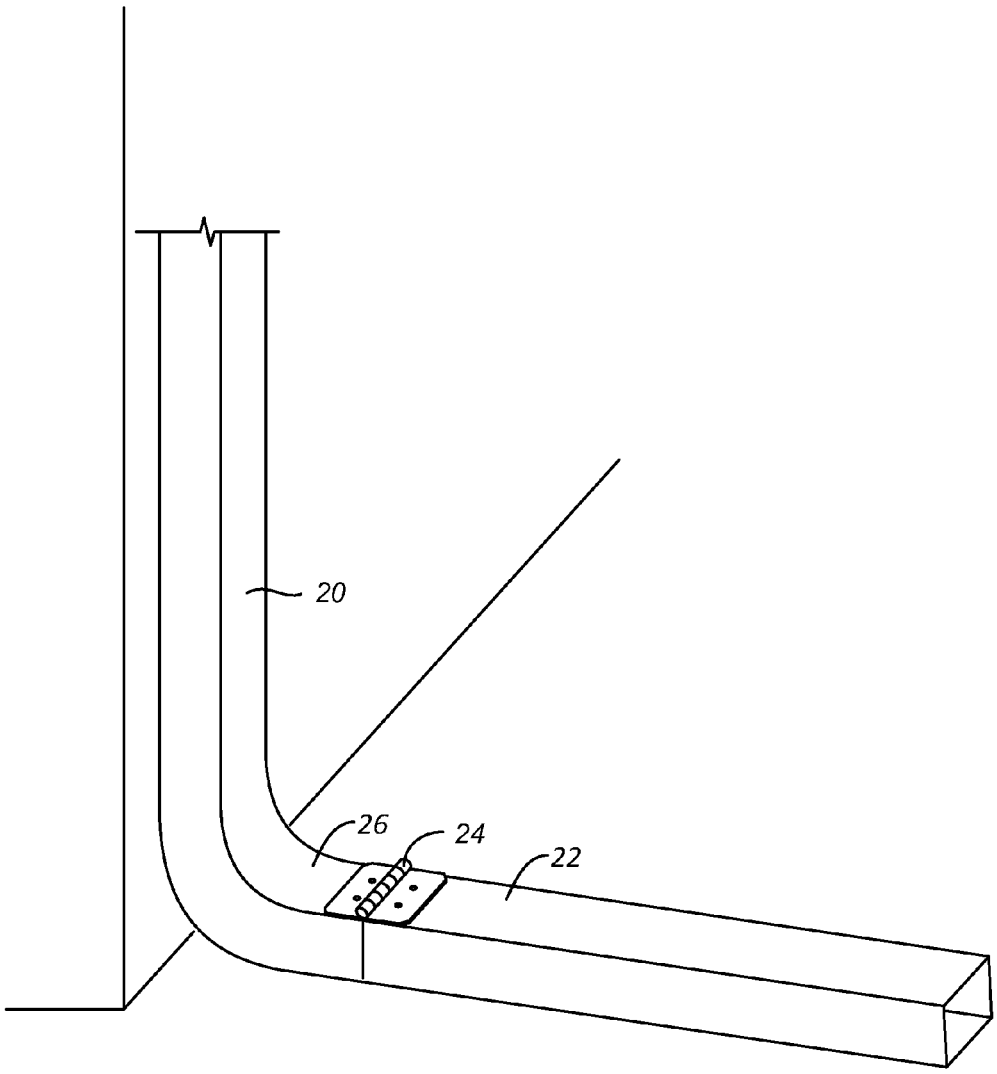
FIG. 1 illustrates a perspective view of a representative embodiment of a downspout with a downspout extension and a hinge.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Numerical data may be expressed or presented herein in a range format. It is to be understood that such a range format is used merely for convenience and brevity and thus should be interpreted flexibly to include not only the numerical values explicitly recited as the limits of the range, but also as including all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

The description may use perspective-based descriptions such as up/down, back/front, left/right and top/bottom. Such descriptions are merely used to facilitate the discussion and are not intended to restrict the application or embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical or electrical contact. However, "coupled" may also mean that two or more elements are not in direct contact with each other, but yet still cooperate or interact with each other.

Figure 2:
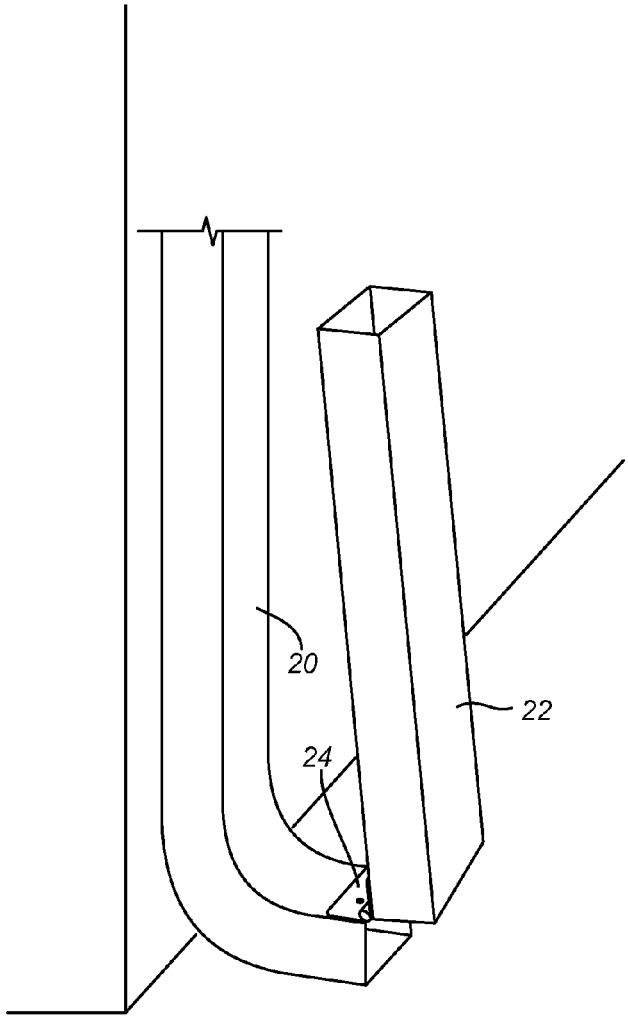
FIG. 2 illustrates a perspective view of the downspout and a downspout extension of FIG. 1 with the downspout extension in a vertical position.

Reference will now be made more particularly to embodiments of the present downspouts and hinged downspout extensions. As shown in FIG. 1, downspouts 20 can be used to control water flow coming off of roofs. Downspouts 20 can distribute water onto the ground and potentially away from the foundation of a house or other edifice by use of a downspout extension 22. In some instances, a downspout 20 includes an elbow or bend 26 that directs water away from a foundation of the building. Because the downspout extension 22 extends away from the building, it may occasionally interfere with landscape maintenance, foot traffic, and other use of the area around the downspout extension 22. Thus, a hinge 24 can be provided that enables the downspout extension to be raised up to a vertical position, as shown in FIG. 2. The hinge 24 can allow the downspout extension 22 to selectively pivot up off the ground without removing the downspout extension 22 to the downspout 20.

In some embodiments, the hinge 24, including all of its component parts, is made of any desirable material with suitable properties and/or characteristics. By way of non-limiting example, in some embodiments, the hinge 24 is made of one or more of the following materials or combinations thereof: metallic materials, polymer materials, composite materials, synthetic materials, or resins. Non-limiting examples of specific metallic materials include: aluminum, steel, iron, stainless steel, and combinations and alloys thereof. In such embodiments, the desirable or selected material is homogenous or uniform throughout while in other embodiments the selected material includes voids or encapsulates non-homogenous materials. In some embodiments, the material selected is dictated by the intended use and/or method of manufacture of the hinge 24. For example, in embodiments wherein the hinge is formed by bending a flat sheet of material, the material can be bendable and durable. For instance, in some instances, the two hinge members 140 are manufactured of heavy duty aluminum. This material can resist corrosion even in wet outdoor environments. The thickness of the material of the two hinge members 140 can be between about 0.01 and about 0.1 inches, such as about 0.01 inches, about 0.02 inches, about 0.024 inches, about 0.03 inches, about 0.04 inches, about 0.05 inches, about 0.06 inches, about 0.07 inches, about 0.08 inches, about 0.09 inches, and about 0.1 inches. Using materials of these thicknesses can enable screws 136 inserted through the hinge members 140 to be retained, rather than backing out over time.

Figure 3:
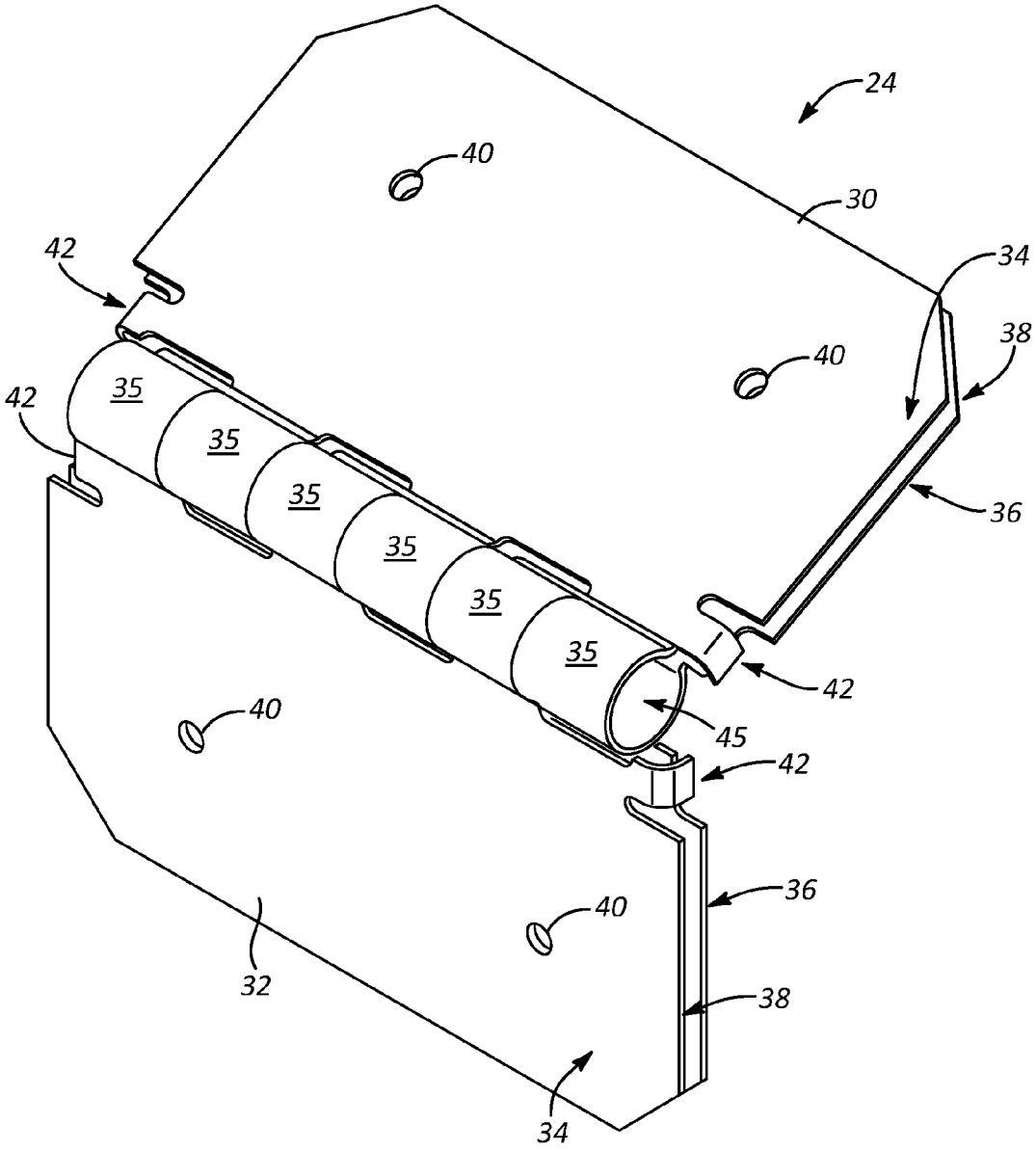
FIG. 3 illustrates a perspective view of a representative embodiment of a hinge.

FIG. 3 illustrates an isolated view of some embodiments of a representative hinge 24. As shown, the hinge 24 can include a first section 30 and a second section 32 coupled together with a pivoting member 35. In some configurations the hinge 24 consists of only the first 4 second sections 30, 32. The first and second sections 30, 32 can be substantially identical in function and structure. In use, a wall of the downspout 20 can be connected to the first section 30 and wall of the downspout extension 22 can be connected to the second section 32. These connections can enable the downspout extension 22 to be pivotally raised upwards to a vertical orientation, as shown in FIG. 2.

In some embodiments, each of the first and second sections of the hinge 30, 32 can include two substantially parallel plates 34, 36 separated by a gap 38. The gap 38 can be shaped and size to receive a wall of the downspout 20 or downspout extension 22 in a relatively snug manner that permits little play or movement therein. Furthermore, the two plates 34, 36 can include pilot holes 40 formed therein through which a screw, brad, or other fastener can be inserted to secure the wall of the downspout 20 or downspout extension 22 between the plates 34, 36. The pilot holes 40 can be pre-stamped and/or pre-drilled. The pilot holes 40 can be sized to accommodate a suitably sized screw. In a non-limiting example, the pilot holes 40 have a diameter of about 1/16 of an inch, 3/32 of an inch, about 1/8 of an inch, about 5/32 of an inch, or about 3/16 of an inch.

When the two parallel plates 34, 36 are secured about a wall of a downspout 20 or downspout extension 22, the parallel plates 24, 26 can reinforce the wall. Since the walls are generally thin aluminum or other such thin materials, they can tear or bend under stress. The parallel plates 34, 36 can thus provide reinforcement to these wall portions to prevent damage during use of the hinge.

In some configurations, a flange 42 is formed between the plates 34, 36 which can ensure a proper spacing of the gap 38 and also limit the depth with which a wall of the downspout 20 or downspout extension 22 can be inserted within the gap 38. As shown, the flange 42 can be coupled to one or both plates 34, 36. In some embodiments, the flange 42 is formed by bending a portion of one of the plates 34, 36. The flange 42 can provide a space of a predetermined distance between the end of the downspout 20 wall or the downspout extension 22 wall within the plates 34, 36 that can improve the function of the hinge 24 in normal use by lowering the likelihood of catching or binding.

As shown, in some embodiments, the hinge 24 include one or more pivot members 35 that are coupled to the plates 34, 36 of the first and second sections 30, 32. The pivot members 35 can form a hinge pin channel 45 into which a hinge pin (shown as 55 in FIGS. 8A-8B) can be inserted. The hinge pin 55 can serve to connect the first section 30 and the second section 32 of the hinge 24 together, as well as to facilitate pivoting of the first section 30 and the second section 32 about the pivot member 35.

Figure 4:
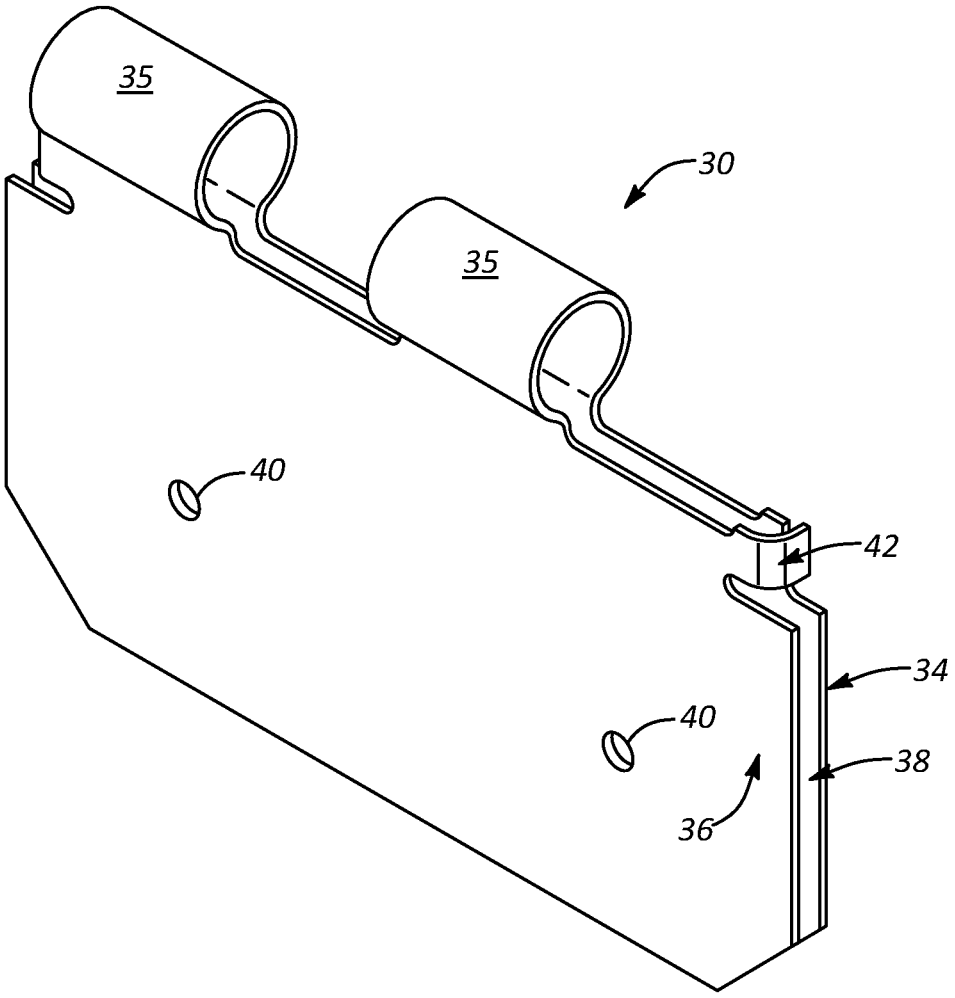
FIG. 4 illustrates a perspective view of an alternative representative embodiment of a hinge.
Figure 5:
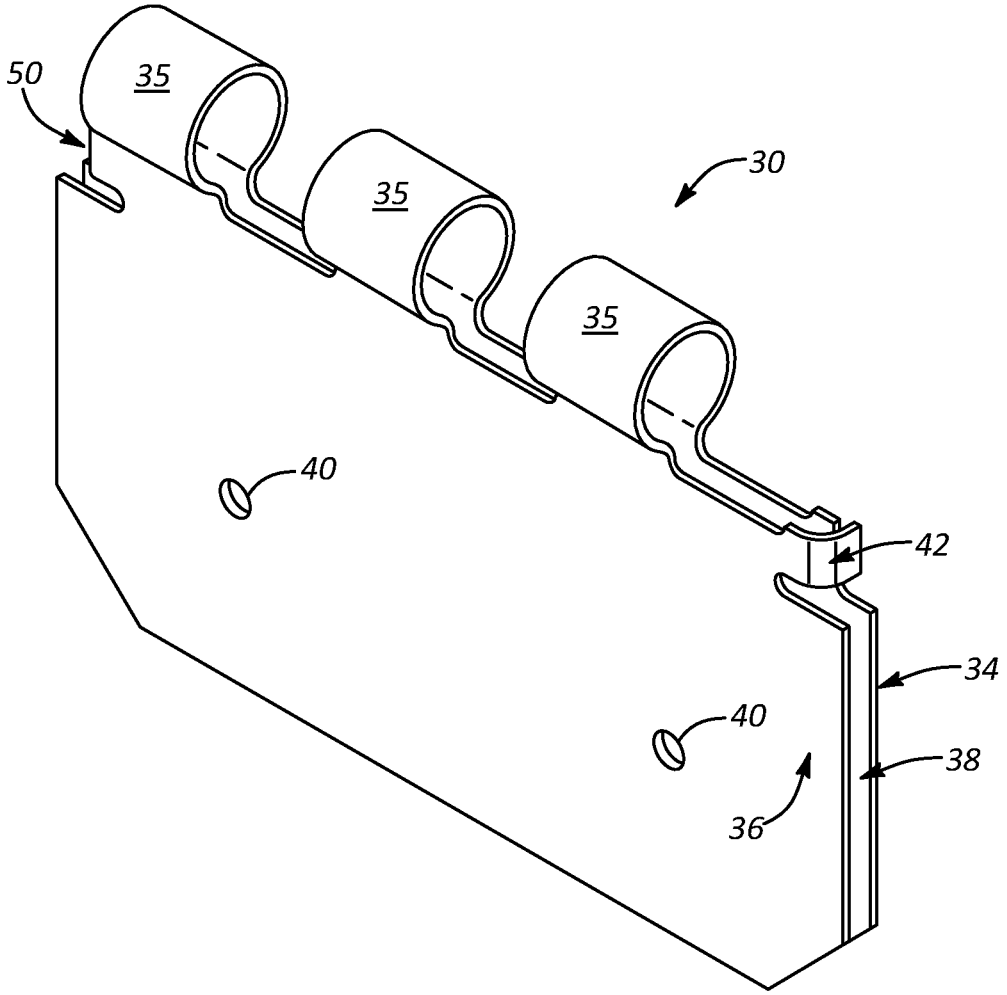
FIG. 5 illustrates a perspective view of an alternative representative embodiment of a hinge.

FIG. 4 illustrates embodiments of a section 30 of a hinge 24 that includes two pivot members 35 rather than three as in the embodiments of FIGS. 3 and 5. In other embodiments, a single section 30, 32 can include only one pivot member 35, four pivot members 35 or more than four pivot members 35. FIG. 5 illustrates embodiments of a section 30 of a hinge 24 that includes three pivot members 35. In both of the embodiments illustrated in FIGS. 4 and 5, the illustrated section 30 of the hinge 24 could be coupled with another section 32 using a hinge pin 55 to form the hinge 24, as shown in FIG. 3.

Figure 6:
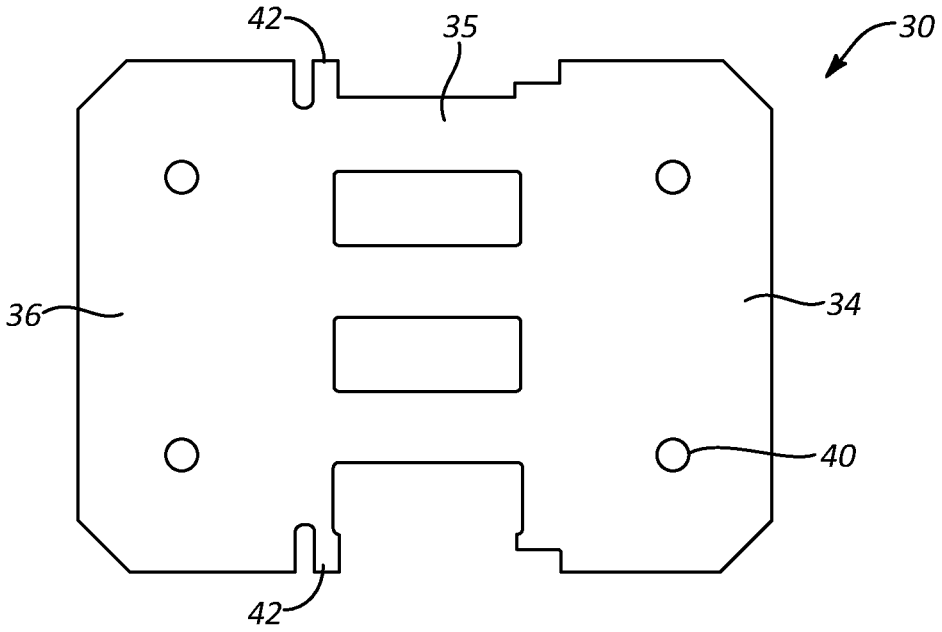
FIG. 6 illustrates a plan view of a section of the hinge of FIG. 5, according to some embodiments.
Figure 7A:
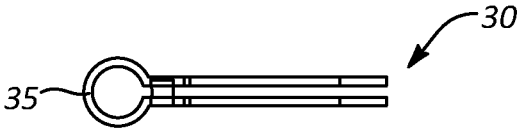
FIG. 7A illustrates a top view of a section of the hinge of FIG. 5, according to some embodiments.
Figure 7B:
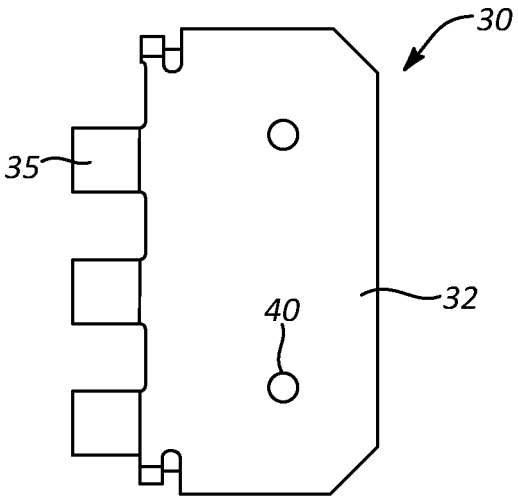
FIG. 7B illustrates a front side view of a section of the hinge of FIG. 5, according to some embodiments.
Figure 7C:
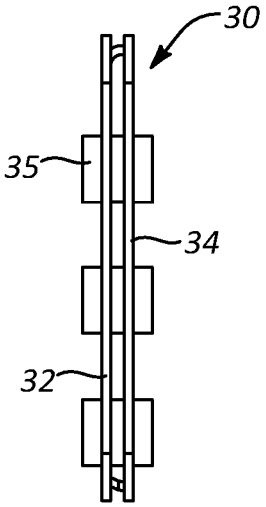
FIG. 7C illustrates a side view of a section of the hinge of FIG. 5, according to some embodiments.

FIG. 6 illustrates a plan view of the section 30 of the hinge 24 shown in FIG. 5. This section 30 can be stamped, cut, drilled, or otherwise formed of a unitary, single-piece material. Using one or more folding processes, the section 30 can be formed into the section 30 illustrated in FIG. 5. FIG. 7A illustrates a top view of the section 30 of FIG. 5. FIG. 7B illustrates a front side view of a section 30 of FIG. 5. And, FIG. 7C illustrates a side view of the section 30 FIG. 5.

Figure 8A:
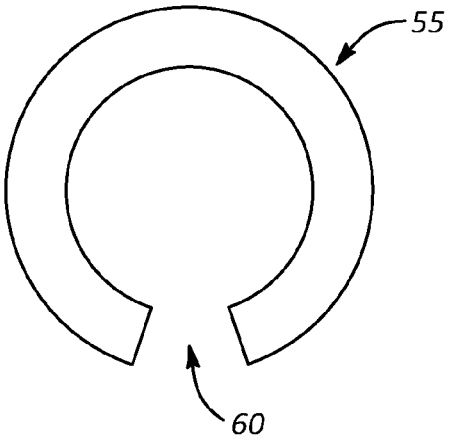
FIG. 8A illustrates a top view of a hinge pin, according to some embodiments.
Figure 8B:
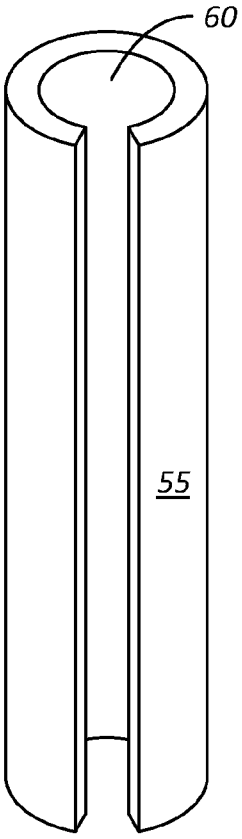
FIG. 8B illustrates a perspective view of a hinge pin, according to some embodiments.

FIGS. 8A and 8B illustrates embodiments of a hinge pin 55 configured to be inserted into a hinge pin channel 45 of the hinge 24. As shown, the hinge pin 55 can include a cylindrically formed material having a gap 60 extending longitudinally along the hinge pin 55. The gap 60 can allow the hinge pin 55 to contract and expand as it is inserted into the hinge pin channel 45.

When assembled, the ability to pivot the hinge 24 can be adjusted by applying opposite compressive forces against the parallel plates 34, 36 to decrease the size of the gap 38 and reduce the size of the hinge pin channel 45. As the size of the hinge pin channel 45 decreases, the force on the hinge pin 55 is increased, creating friction that resists pivoting movements of the hinge 24. As this force is increased, the downspout extension 22 can be elevated to the vertical position and remain in that position while to enable users to access the areas under the downspout extension 22 for maintenance, care, foot traffic, or other uses.

Figure 9:
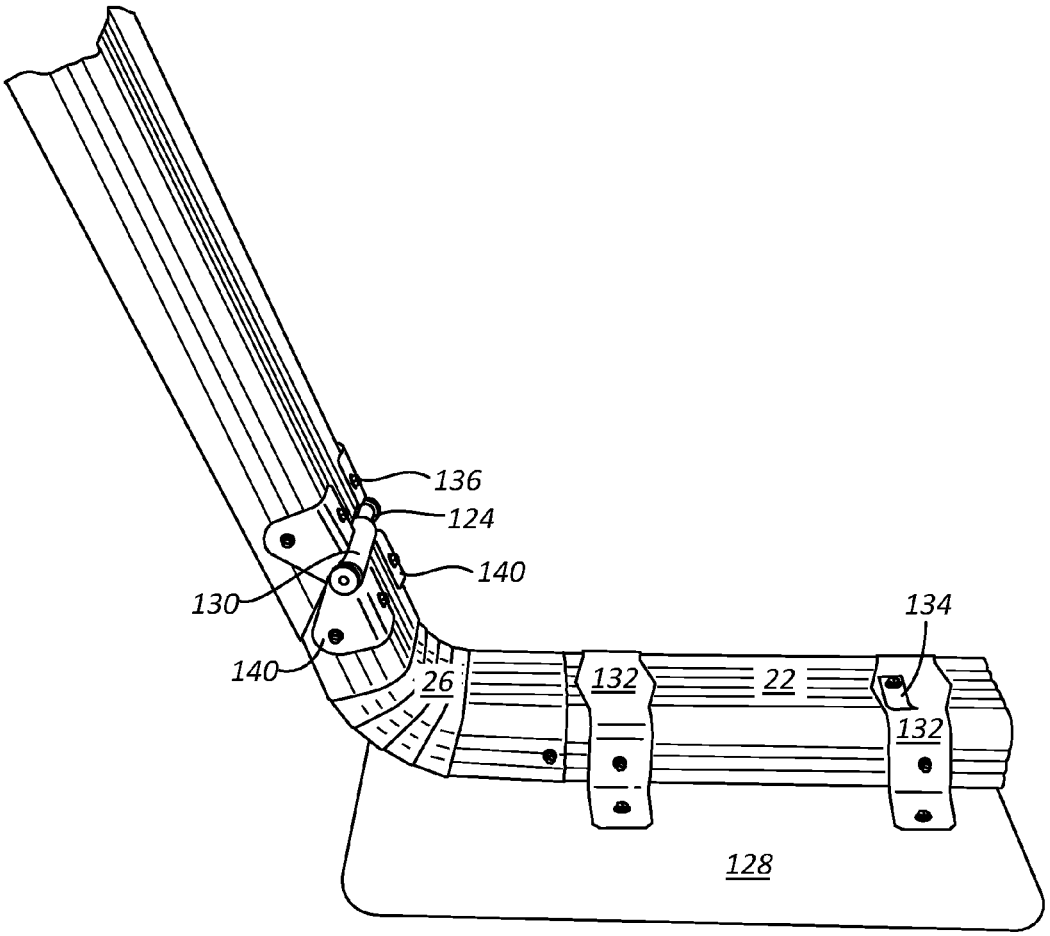
FIG. 9 illustrates a perspective view of another representative embodiment of a downspout with a downspout extension and a hinge.

Reference will now be made to FIGS. 9 through 13, which illustrate other embodiments of a hinged downspout 20. Reference will first be made to FIG. 9, which depicts a downspout 20 pivotally coupled to a downspout extension 22. The downspout extension 22 may rest on the ground or on another surface. A mounting surface 128 can be connected to the downspout extension 22 using one or more bands that are wrapped around the downspout extension 22 and fastened to the mounting surface 128 and the downspout extension 22. The downspout extension 22 also can include a latch 134 that latches the downspout extension 22 in a vertical orientation when it is lifted up. The latch 134 can be pivotally coupled to the downspout extension 22 so that the latch 134 can pivot about a fastener and latch itself to a feature (not shown) of the downspout 20. In other words, the latch 134 can be used to hold the downspout extension 22 in the vertical position until the property owner rotates it horizontally to allow the downspout extension 22 to rest in the horizontal position.

As shown, in some embodiments, the hinge 124 can include two hinge members 140. These two hinge members 140 can function together to stabilize the downspout 20 and the downspout extension 22 both vertically and horizontally. Improved, the horizontal and vertical stability can be provided by the portions of the hinge members 140 that connect to the side walls of the downspout 20 acting in combination with the portions of the hinge members 140 that connect to the front wall of the downspout 20. This stability can allow the two hinge members 140 to be fastened to the downspout 20, the downspout elbow 26, or the downspout extension 22.

Figure 10:
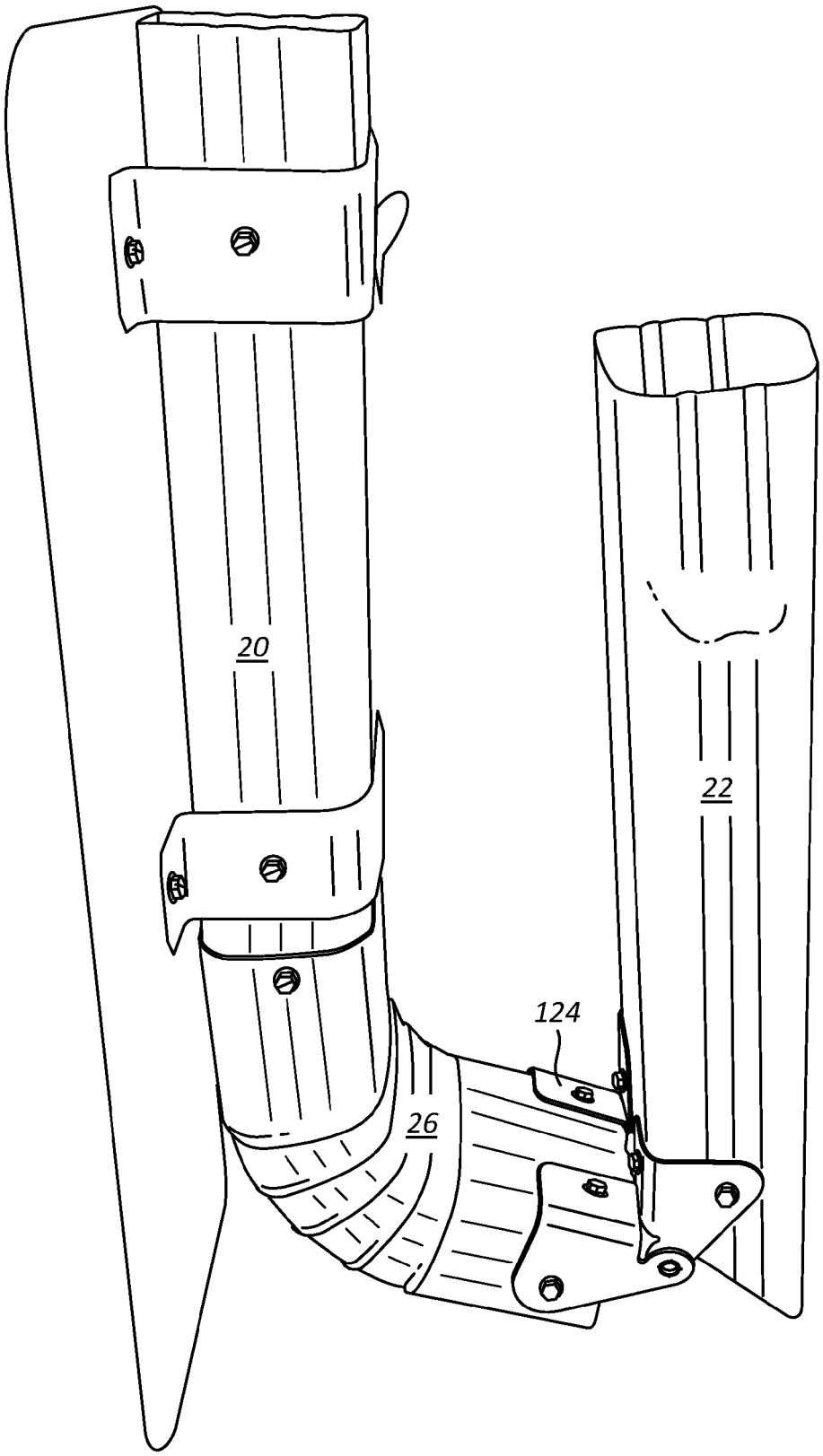
FIG. 10 illustrates a perspective view of the representative embodiment of FIG. 9 in a vertical position.

The use of two opposing hinge members 140 located both above and on the side of the downspout 20 or downspout extension 22 can give this hinge 124 enhanced stability and durability as it guides the downspout extension 22 in its lateral rotations between the horizontal position, shown in FIG. 9, and the vertical position, shown in FIG. 10. The opposing hinge members 140 can also function to protect and guide the downspout extension 22 as it is lowered to the horizontal position by accurately aligning it with the elbow 26. Additionally, the use of two opposing hinge members 140 to form a single hinge unit 142 can allows this hinge 142 to be installed on any sized downspout extensions 22, reducing the need to shop for or carry more than one size of hinge.

The use of the two hinge members 140 can enable the hinge 124 to pivot about a relatively large range of motion. For instance, the hinge 124 can pivot about 100 to about 160 degrees which allows the downspout extension 22 to be raised past the vertical position. This allows the downspout extension 22 to remain in the vertical position without falling back to the horizontal position until the user moves the downspout extension 22 to the horizontal position.

Each of the two hinge members 140 can be nearly identical or identical, reducing the need for carrying and/or purchasing two separate components. Each of the two hinge members 140 can be made to be more strong and more durable than the material of the downspout 20 and the downspout extension 22. This can add strength and stability to the downspout 20 and the downspout extension 22, which are sometimes made of thin sheets of aluminum. This can further alleviate the issues of instability and weakness associated with the lighter aluminum as the heavy and stronger hinge members 140 sandwiches the lighter material of the downspout 20 and the downspout extension 22. For instance, in some instances, the two hinge members 140 are manufactured of heavy duty aluminum. This material can resist corrosion even in wet outdoor environments. The thickness of the material of the two hinge members 140 can be between about 0.01 and about 0.1 inches, such as about 0.01 inches, about 0.02 inches, about 0.024 inches, about 0.03 inches, about 0.04 inches, about 0.05 inches, about 0.06 inches, about 0.07 inches, about 0.08 inches, about 0.09 inches, and about 0.1 inches. Using materials of these thicknesses can enable screws 136 inserted through the hinge members 140 to be retained, rather than backing out over time.

As further shown in FIG. 9, the downspout 20 and the downspout extension 22 can be shaped to form a gap 130 when the downspout extension 22 is in a horizontal position. The length of the gap 130 when the downspout extension 22 is in a horizontal position can be between about 0.5 inches and about 1.0 inch, such as, for example, about 0.75 inches. The gap 130 can assist to ensure that the bottom of the downspout extension 22 underlaps the bottom of the elbow 26. If this gap 130 were not maintained the water may otherwise escape the elbow 26 before entering the downspout extension 22 causing water to enter the ground adjacent to the properties foundation and washed away landscaping. The gap 130 can also allow a property owner to quickly see if there is any debris caught in the elbow 26 of the downspout extension 22.

As shown, the gap 130 can be created in part by the geometry of the cut of the downspout 20 and the downspout extension 22. For example, the downspout 20 can be formed to taper downwards from the front to the back (the side closest to the home or building), as shown in FIGS. 9 and 10. Furthermore, the top of the downspout extension 22 can be cut relatively flat at a constant location along the longitudinal axis of the downspout extension 22.

Figure 11:
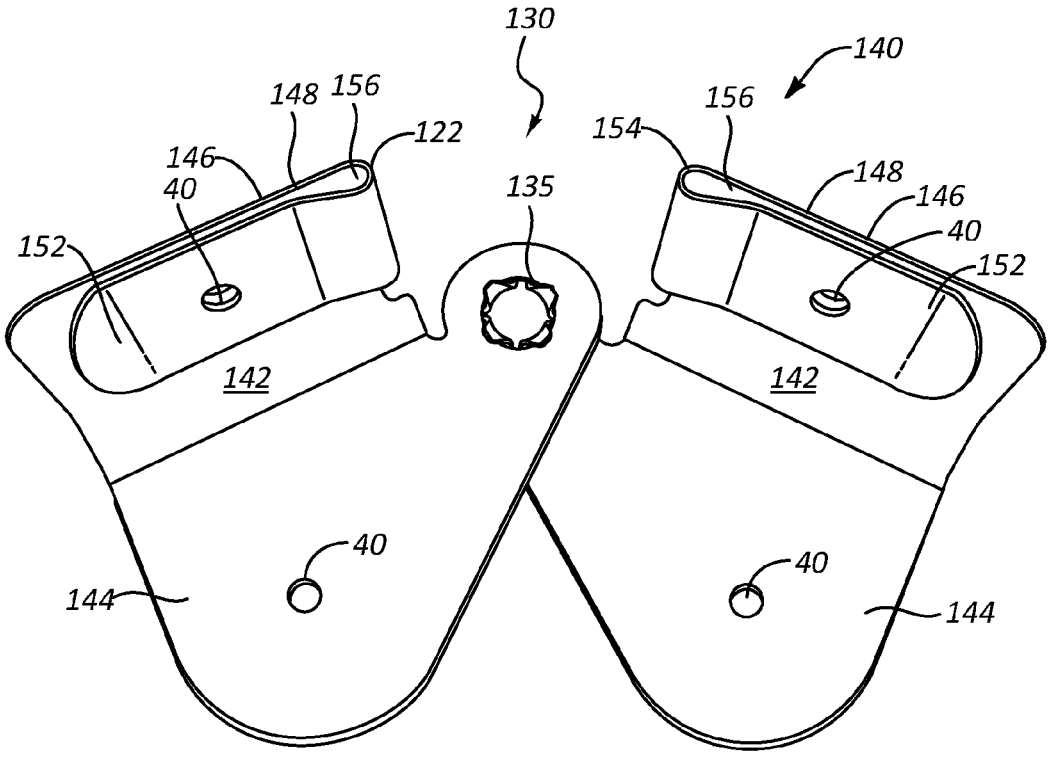
FIG. 11 illustrates an isolated perspective view of a hinge member of FIG. 9.

Reference will now be made to FIG. 11, which illustrates an isolated hinge member 140. As shown, the hinge member 140 can include a first side plate 144 coupled to a second side plate 145 with a pivot member 135. The first side plate 144 can be substantially parallel to the second side plate 145 to enable the hinge member 140 to pivot about the pivot point of the pivot member 135. A front member 146 can extend away from each of the first and second side plates 145. The front member 146 can be positioned on the front of the downspout, a side which is not adjacent a building and the side to which the downspout extension 22 extends. In some configurations, each of the front members 146 extends substantially perpendicularly from the side plates 145 from which it extends. In some configurations, the front member 152 does not immediately extend substantially perpendicularly from a side plate 144, but can include one or more other bends that can conform to the exterior shape of the downspout 20 or downspout extension 22, as shown.

The front member 142 may be shaped so as to maximize surface contact between the hinge member 140 and the down spout 20, 22, and thus strengthen and reinforce the downspout 20, 22 point of connection to the hinge member 140.

Each front member 146 can include a first front plate 148 and a second front plate 152. The first front plate 148 and the second front plate 152 can be substantially parallel to one another, at least for a substantially portion of their bodies. Moreover, as shown, the first front plate 148 and the second front plate 152 can be coupled together at an edge thereof that is closest to the pivot member 135. In some instances, this coupling is a fold 154 that forms a pocket 156. In use, a wall of the downspout 20 or downspout extension 22 can be inserted into the gap or pocket 156 between the first front plate 148 and the second front plate 152 until it abuts the fold 154 or other coupling. At this point, the wall of the downspout 20 or downspout extension 22 can be secured within the pocket 156 by driving a screw, brad, or other fastener through a pilot hole 40 extending through the first front plate 148 and the second front plate 152. As mentioned above, these two plates 148, 152 can reinforce the wall of the downspout 20 or downspout extension 22 to resist tearing or damage during use of the hinge 124.

FIG. 11 further shows that the side plates 145 can include one or more pilot holes 40 formed therein to secure the side plates 145 to a sidewalls of the downspout 20 and a sidewall of the downspout extension 22. In this way, the hinge member 140 can significantly strengthen the lateral stability of the hinge 124. The pilot holes 40 in the side plates 145 and/or the first front plate 148 and the second front plate 152 can be sized to accommodate a suitably sized screw. In a non-limiting example, the pilot holes 40 have a diameter of about 1/16 of an inch, 3/32 of an inch, about 1/8 of an inch, about 5/32 of an inch, about 3/16 of an inch, or about 7/32 of an inch.

In some embodiments, each of the side plates 145 and the corresponding front members 146 are formed of a single-piece of material that is folded to form the respective components and features. Furthermore, each of the sets of side members 155 and front members 146 can substantially mirrored each other, in that each set is substantially the mirror image of the other, as shown in FIG. 11.

In some embodiments a removable sheath or cover may be selectively placed to cover the gap formed between the down spout 20, 22.

Figure 12A:
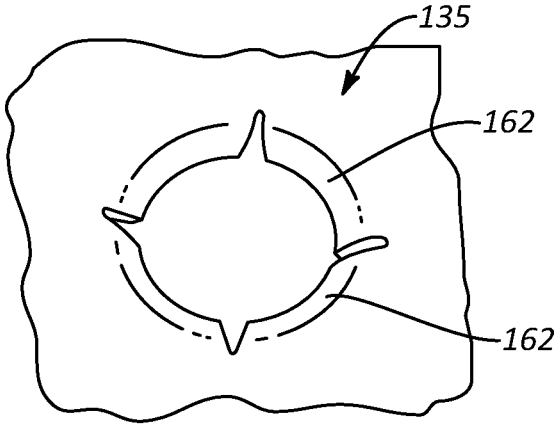
FIG. 12A illustrates an outside side view of a pivoting member, according to some embodiments.
Figure 12B:
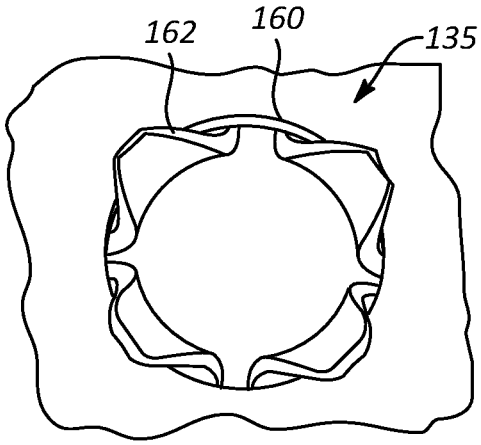
FIG. 12B illustrates an inside side view of the pivoting member of FIG. 12A.

FIGS. 12A and 12B illustrate close-up inside and outside views, respectively, of the pivot member 135 of FIG. 11. As shown, the pivot member 135 can provide relatively smooth operation of the hinge 124 without allowing for undesirable movement or play which could lead to failure of the hinge 124 over time. The pivot member 135 can include a hole 160 formed in one of the first or second side plates 145 and leaves 162 formed in the other of the first or second side plates 145. As further shown, the leaves 162 can be folded in through the hole 160 and back on themselves to secure the leaves 162 within the hole 160. In some configurations, a lack of play and smoothness can be achieved in the pivot member 135 by creating a tight fitting between the leaves 162 and the hole 160. Furthermore, the tension of the pivot member 135 can be quickly and simply adjusted by crimping or loosening the leaves 162. Crimping the leaves 162 can adjust the holding power of the hinge when the downspout extension 22 is in the vertical position, even in instances in which the downspout extension has a length between about 1 foot to about 10 feet or increments therebetween.

What is claimed:

1. A downspout hinge comprising:

two hinge members, each of the two hinge members comprising:

a first side plate further comprising a first side plate front member, a second side plate further comprising a second side plate front member wherein the first side plate and second side plate are coupled together with a pivot member; and the first side plate front member and the second front plate side member further comprise a first front plate and a second front plate, the first front plate being substantially parallel to the second front plate, the first front plate being coupled to the second front plate proximate the pivot member, wherein each combination side plate front member structure is a single-piece structure.

2. The downspout hinge of claim 1, wherein the first side plate and the second side plate are adjacent and substantially parallel to each other.

3. The downspout hinge of claim 1, wherein each of the front members extends substantially perpendicular to each of the first side plate and the second side plate.

4. The downspout hinge of claim 1, wherein the pivot member includes a hole in the first side plate and a set of leaves formed in the second side plate, the set of leaves being folded through the hole and back on themselves.

5. The downspout hinge of claim 1, wherein the two hinge members are formed of a folded sheet of aluminum having a thickness between about 0.01 inches to 0.1 inches.

6. A hinge comprising:

two adjacently aligned hinge members joined by a pivot member wherein the hinge members rotate around the pivot member in a primary plane, the pivot member comprising a hole in the first side plate and a plurality of leaves formed in the second side plate wherein the leaves are folded through the hole and back on themselves; and each of hinge members further comprising; a front member extending from the first side plate and a front member extending from the second side plate, the front member comprising a first front plate and a second front plate, the first front plate being substantially adjacent and parallel to the second front plate, the first front plate being coupled to the second front plate proximal the pivot member.

7. The hinge of claim 6 wherein the first side plate and the second side plate are substantially triangular in shape.

8. The hinge of claim 6 wherein the first front plate and the second front plate are formed by folding said front member over onto itself to form two parallel plates.

9. The hinge of claim 6 wherein each combination side plate front member structure is a single-piece structure.

10. The hinge of claim 6, wherein the two hinge members are formed of a folded sheet of aluminum having a thickness between about 0.01 inches to 0.1 inches.

11. A hinge comprising:

two hinge members, each of the two hinge members comprising:

a first side plate and a second side plate coupled together with a pivot member wherein the pivot member comprises a hole in the first side plate and a set of leaves formed in the second side plate, the set of leaves being folded through the hole and back on themselves; and a front member extending from each of the first side plate and the second side plate, the front member comprising a first front plate and a second front plate, the first front plate being substantially parallel to the second front plate.

12. The hinge of claim 11 wherein each combination side plate front member structure is a single-piece structure.

13. The hinge of claim 11, wherein the two hinge members are formed of a folded sheet of aluminum having a thickness between about 0.01 inches to 0.1 inches.

* * * * *